US008512617B2

(12) United States Patent
Oldenburg

(10) Patent No.: US 8,512,617 B2
(45) Date of Patent: Aug. 20, 2013

(54) GOLF CLUB SHAFT AND METHOD OF PRODUCING THE SAME

(75) Inventor: John Oldenburg, Poway, CA (US)

(73) Assignee: Aldila, Inc., Poway, CA (US)

( * ) Notice: Subject to any disclaimer, the term of this patent is extended or adjusted under 35 U.S.C. 154(b) by 0 days.

(21) Appl. No.: 12/028,753

(22) Filed: Feb. 8, 2008

(65) Prior Publication Data

US 2008/0128960 A1 Jun. 5, 2008

Related U.S. Application Data

(62) Division of application No. 11/655,155, filed on Jan. 19, 2007, now Pat. No. 7,780,546.

(60) Provisional application No. 60/760,656, filed on Jan. 20, 2006.

(51) Int. Cl.
*B29C 45/14* (2006.01)

(52) U.S. Cl.
USPC ..... 264/257

(58) Field of Classification Search
USPC ..... 264/635, 257; 473/318, 319
See application file for complete search history.

(56) References Cited

U.S. PATENT DOCUMENTS

| | | | |
|---|---|---|---|
| 2,007,970 | A | 7/1935 | Hartley |
| 3,963,236 | A | 6/1976 | Mann |
| 3,998,458 | A | 12/1976 | Inoue et al. |
| 4,023,801 | A | 5/1977 | VanAuken |
| 4,132,579 | A | 1/1979 | VanAuken |
| 4,319,750 | A | 3/1982 | Roy |
| 4,455,022 | A | 6/1984 | Wright |
| 5,028,464 | A | 7/1991 | Shigetoh |
| 5,143,374 | A | 9/1992 | Shibasaki |
| 5,156,396 | A | 10/1992 | Akatsuka et al. |
| 5,308,062 | A | 5/1994 | Hogan |
| 5,421,573 | A | 6/1995 | Kawamatsu |
| 5,485,948 | A | 1/1996 | McCrink |
| 5,620,380 | A | 4/1997 | Tennent et al. |
| 5,626,529 | A | 5/1997 | Roy |

(Continued)

FOREIGN PATENT DOCUMENTS

| | | | |
|---|---|---|---|
| JP | 3-66732 | U | 6/1991 |
| JP | 7-329195 | A | 12/1995 |

(Continued)

OTHER PUBLICATIONS

Japanese Office Action, dated Jun. 6, 2011, for Japanese Application No. 2008-551430, including English translation.

*Primary Examiner* — Larry Thrower
(74) *Attorney, Agent, or Firm* — Birch, Stewart, Kolasch & Birch, LLP

(57) ABSTRACT

A composite golf club shaft having a reinforcing ribbon of composite material spiraling along an intermediate portion of the shaft and bonded thereto to reinforce the hoop strength of the shaft. The ribbon is shaped into a rib of different cross-sectional shapes, the preferred embodiment being a thin rectangular shape approximately 0.125 wide of an inch and spiraling at a rate of four turns per inch, producing a groove of equal width. The methods of the invention produces the shaft by providing a mandrel having the outside shape desired for the shaft's inside surface; wrapping a ribbon of reinforcing material around the shaft in a spiral groove therein; forming the shaft body around the mandrel; and separating the mandrel from the shaft after curing, by unscrewing the mandrel.

10 Claims, 2 Drawing Sheets

(56) References Cited

U.S. PATENT DOCUMENTS

| | | | |
|---|---|---|---|
| 5,634,861 | A | 6/1997 | Yamamoto et al. |
| 5,904,628 | A | 5/1999 | MacKay, Jr. et al. |
| 6,273,830 | B1 | 8/2001 | Takemura et al. |
| 6,354,957 | B1 | 3/2002 | Saito |
| 6,652,389 | B2 | 11/2003 | Hisamatsu et al. |
| 2002/0187850 | A1 | 12/2002 | Kluck et al. |
| 2004/0092330 | A1* | 5/2004 | Meyer et al. ..... 473/318 |
| 2006/0128494 | A1 | 6/2006 | Kumamoto |

FOREIGN PATENT DOCUMENTS

| | | | |
|---|---|---|---|
| JP | 8-28997 | | 2/1996 |
| JP | 8-289947 | A | 11/1996 |
| JP | 2000-301621 | A | 10/2000 |

* cited by examiner 30
31
32
33
34
34a
34b
34c
35
37
10
11
14
15

GOLF CLUB SHAFT AND METHOD OF PRODUCING THE SAME

This application is a Divisional of co-pending application Ser. No. 11/655,155 filed on Jan. 19, 2007, and for which priority is claimed under 35 U.S.C. §120; which claims priority under 35 U.S.C. §119(e) on U.S. Provisional Application No. 60/760,565 filed on Jan. 20, 2006, the entire contents of all are hereby incorporated by reference.

FIELD OF THE INVENTION

This invention relates to golf club shafts, and more particularly to composite golf club shafts having elongated tubular bodies composed of fiber-and-resin composite materials.

BACKGROUND OF THE INVENTION

Composite golf club shafts typically have hollow tubular bodies that taper longitudinally from larger, so-called "butt" or "grip" ends toward smaller, so-called "tip" ends upon which golf club heads are mounted in the completed golf clubs. Such shafts typically are generally circular in transverse cross-sectional shape, both at the outside and inside surfaces of the shaft, having walls that are of selected thicknesses and compositions to provide the strength, flexibility and weight desired for a particular golf club.

The design and manufacture of composite golf club shafts are highly developed arts, providing a wide variety of different shafts with characteristics that are intended to suit the abilities and personal preferences of a wide variety of golfers. Typically, composite shafts are designed to be concentric about their longitudinal axes while varying substantially in outside diameter, from the larger grip end to the smaller tip end. The concentricity of the inside and outside surfaces is designed to be very precise, to produce the desired wall thickness and flexing characteristics, and remains stable when at rest, that is, when not loaded and stressed by outside forces.

During the swing, however, the forces acting on the shaft as the club is swung through the golf stroke are great enough to deform the shaft, longitudinally in flexing along the length of the shaft and torsionally in twisting of the shaft, and also transversely, causing the cross-sectional shape of the shaft to deform and become oval or elongated. This deformation is resisted by the wall strength of the shaft, referred to as "hoop strength", but occurs in different degrees and directions, first in the so-called "swing plane (or planes)" of the golfer's swing and secondarily in the so-called "droop plane" that is generally perpendicular to the swing plane. The amounts of these deformations are functions of the forces applied throughout the swing and ball impact, and the physical properties of the shaft resisting these forces.

In the industry, various approaches are available to provide the desired properties in the shaft for improved performance, including increasing the wall thickness and the amounts of different composite materials in the wall, and varying the angles of the fibers in the composite materials relative to the longitudinal axis of the shaft.

Increased use of so-called "angle fibers" provides increased transverse wall strength. All such changes affect other performance characteristics of the shaft, including weight and longitudinal and torsional flexibility. In general, the technology of design and manufacture of golf club shafts, including the selection, placement and use of different types and angles of fibers, are well known in the industry to those skilled in the art, and this information therefore is included only as general background for the present invention. The present invention is directed to a novel improvement in golf club shafts that contributes significantly to the hoop strength of a golf club shaft to improve its performance characteristics without adversely affecting other performance characteristics of the shaft.

BRIEF SUMMARY OF THE INVENTION

The present invention provides a novel golf club shaft, and a novel method for producing the shaft, in which a reinforcing ribbon or rib of composite material is joined to the inside surface of the shaft along a pre-selected portion of its length, and spirals around the inside surface while extending into the interior of the shaft. The ribbon or rib is bonded to the composite material of the shaft wall, and has a pre-selected cross-sectional shape and spiral pitch to provide the desired reinforcement of the hoop strength of the shaft without significantly increasing its weight.

In the presently preferred embodiment shown herein, the ribbon or rib is generally rectangular in transverse cross-section, has a radial height in the range of 0.002 to 0.100 of an inch and a width in the range of 0.050 to 0.250 of an inch, and specifically a height of approximately 0.005 of an inch, a width of approximately 0.125 of an inch, and a spiral of approximately four turns per inch. The rib is positioned in an intermediate portion of the shaft where reinforcement is most important, extending from a point near the grip end to a point spaced from the tip end, the rib of the preferred embodiment extending along between thirty and forty inches of the length and ending twelve to eighteen inches from the tip end. A suitable specific example provides a rib extending along approximately thirty-eight inches of the length of the shaft and ending approximately fourteen inches from the tip end.

The method of the invention comprises the steps of providing an elongated mandrel having an outside surface shaped to form the interior surface of the shaft, including a spiral groove in the mandrel extending around a selected portion of the mandrel; placing in the groove a ribbon of reinforcing material that wraps around the mandrel in the groove; applying composite material to the mandrel to form a tubular shaft body around the mandrel; curing the composite material and bonding the reinforcing material to the shaft body; and separating the shaft from the mandrel. The reinforcing material is applied in the preferred mode of the invention by wrapping a ribbon of reinforcing material in the groove, and the completed shaft is separated from the mandrel by rotating the mandrel as it is withdrawn endwise from the shaft. In its broadest aspect, the method can be practiced by wrapping the ribbon around the outside of the mandrel without a groove, and holding the ribbon in proper spiral position while the body of the shaft is formed.

Other aspects and advantages of the invention will become apparent from the accompanying drawings and detailed description.

BRIEF DESCRIPTION OF THE DRAWINGS

FIG. 2 is a two-part view comparing the present invention to the prior art, FIG. 2A being an enlarged cross-sectional view taken along line 2-2 of FIG. 1 and FIG. 2A being a similar view, not to scale, through a conventional shaft illustrating transverse deformation of the cross-sectional shape under forces during a golf stroke;

FIG. 5 is a set of enlarged schematic cross-sectional views similar to a portion of FIG. 4, illustrating four alternative embodiments of the reinforcing rib;

DETAILED DESCRIPTION OF THE PREFERRED EMBODIMENT

Figures 1, 2A, 2B, 3, 4, 5A, 5B, 5C, 5D:
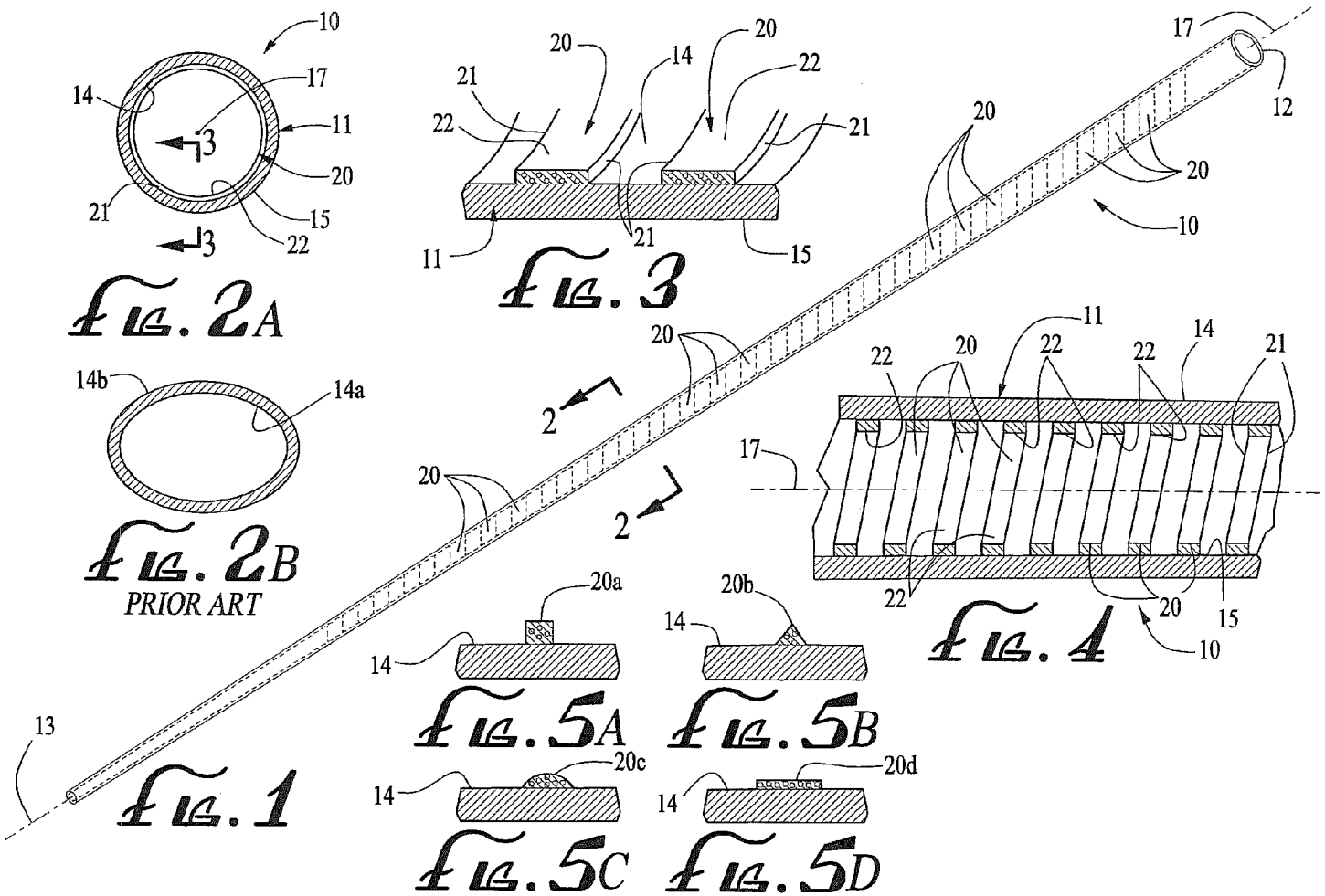
FIG. 2B PRIOR ART
FIG. 1 is a perspective view of a golf club shaft in accordance with the present invention, the taper being somewhat exaggerated for purposes of illustration.
FIG. 3 is an enlarged fragmentary cross-sectional view taken substantially along line 3-3 of FIG. 2A, not shown to scale.
FIG. 4 is a further enlarged detailed view taken within the circle 4 of FIG. 3.

As shown in the drawings for purposes of illustration, the invention is embodied in a composite golf club shaft, indicated generally by the reference number 10, having an elongated tubular body 11 that has a butt or grip end 12, the upper right hand end in FIG. 1, and a tip end 13. A club head (not shown) will be mounted on the tip end, and a grip (not shown) will be disposed around the butt end portion to complete the golf club in a conventional fashion.

The body 11 of the golf club shaft 10 shown on FIG. 1 has a longitudinal taper, as is typical in such shafts, from the larger butt end 12 toward the smaller tip end 13, and has a conventional cross-sectional shape that normally is circular or annular as shown in FIG. 2A when at rest, having inside and outside surfaces 14 and 15 that are circular in transverse cross-section and are generally concentric about the longitudinal axis of the shaft, indicated by the line 17 in FIGS. 1, 2A and 4. The thickness of the wall of the shaft body is shown as constant, but it is to be understood that shafts may be designed and manufactured with variations in the wall thickness along the length of the shaft, for purposes of variations in the performance of the shaft in a golf club.

As has been discussed in general in the Background section, composite golf club shafts are composed of fiber-and-resin materials that are formed into the desired tubular shape on a tapered mandrel, typically composed of metal and having an outside shape that is the shape desired for the inside surface of the shaft to be produced, usually longitudinally tapered and of circular cross-sectional shape. The fiber-and-resin material is wrapped around the mandrel, usually in sheet form that is cut into selected geometric shapes and applied to form a plurality of layers of the sheet materials to make up a body of selected wall thickness and length, which may be in the range of thirty to sixty inches, before being cut down to final size. Various materials, with various fiber types and orientations, are used according to the design of each shaft, in accordance with principles and methods that are well known in the industry. The term "composite material" is used in the broad sense used in the industry, and the types of fibers in the composite materials may be of a variety of types, including, but not limited to, graphite, fiberglass, boron, various metallics and spectra, according to the principles that are well known by those skilled in the art.

Typically, the assembled shaft then is wrapped in a shrink wrap film and cured in an oven (not shown) to form the hardened hollow composite body of the golf club shaft. The mandrel then is withdrawn from the assembly, leaving the shaft with its inside surface matching the outside surface of the mandrel. Subsequently, the shaft can be cut to a desired length for assembly into a golf club. It is to be noted that other procedures, such as filament winding of fiber-and-resin tape or roving onto a mandrel, may be used for applying the composite material, wrapping of sheet material being the illustrative manner of forming the shaft body described herein.

FIG. 2A shows the normal, unstressed condition of the shaft 10 when it is not loaded, and is at rest. The inside and outside surfaces 14 and 15 are circular in cross-section and concentric about the longitudinal axis 17. In contrast, FIG. 2B illustrates the loaded or stressed condition of a prior art shaft, somewhat exaggerated for clarity, the inside and outside surfaces $\mathbf{14}^b$ and $\mathbf{15}^b$ being eccentrically elongated (in a horizontal direction in this figure) in the manner that can occur as a result of the forces acting on the shaft during a golf swing. The forces include both those applied by the golfer (not shown) in the golf stroke, generally in the swing plane, and also in the droop plane, generally perpendicular to the swing plane. This deformation reduces the effectiveness of a golf club shaft and can introduce inconsistencies in the performance of a shaft.

In accordance with the present invention, the body 11 of the shaft 10 is formed with an internal reinforcing ribbon, shaped as a rib 20, of composite material that is joined to the inside surface 14 of the shaft along a selected portion of its length and spirals around the inside surface within the interior of the shaft. The rib is bonded to the composite material of the shaft wall 14 and has a preselected cross-sectional shape and spiral pitch to provide the desired reinforcement of the hoop strength of the shaft.

As shown in FIGS. 2A, 3 and 4, the rib 20 of the preferred embodiment shown herein in detail for purposes of illustration is a thin ribbon of composite material that is generally rectangular in cross-sectional shape, having narrow, generally flat sidewalls 21, and a flat inner wall 22 that forms the inner side of the rib, this preferably (but not necessarily) being continuous. The rib can extend the full length of the shaft, if desired, but preferably extends only along an intermediate portion of the shaft where cross-sectional deformation is of the greatest concern, herein being a selected portion in the range of thirty to forty inches long, terminating approximately fourteen inches from the tip end 13. The presently preferred length is about thirty-eight inches, extending from a point close to the butt end to somewhat more than fourteen inches from the tip end.

Acceptable dimensions of the rib configuration shown in FIGS. 1, 2A, 3 and 4 vary within a wide range, generally from 0.05 of an inch to 0.250 of an inch for the width of the inner wall 22, the presently preferred width being 0.125 of an inch, and a depth or thickness that is relatively thin, in the range of 0.002 of an inch to 0.100 of an inch, herein being approximately 0.005 to 0.006 of an inch. This is the thickness of a ribbon of high-modulus pre-impregnated graphite material, for example, a strip cut from a sheet composed of about twenty-eight percent resin and 180 FAW material, and wrapped spirally in a single layer around the inside surface 14 of the shaft.

The illustrative and presently selected pitch of the spiral is four turns per inch so that the spiral groove defined between successive turns of the spiral rib is about 0.125 of an inch wide, equal to the width of the rib. It bears emphasis that the rib 20 may be formed in various shapes, as illustrated in FIG. 5. This group of possible cross-sectional shapes, all shown on the inside surface 14 of the shaft body 11, include a generally square rib $\mathbf{20}^a$, a generally triangular rib $\mathbf{20}^b$, a convexly curved rib $\mathbf{20}^c$, and an elongated generally rectangular rib $\mathbf{20}^d$, similar to the rib 20 shown in the other views. The amount of composite material in the rib and the spacing of the turns will be determinative of the reinforcing effects of the rib on the hoop strength of the shaft, as well as the increase of weight of the shaft, which preferably as kept as low is practical while achieving the desired increase in hoop strength.

DESCRIPTION OF THE METHOD OF THE INVENTION

The method of the invention comprises the steps of providing an elongated mandrel 30 having an outside surface 31 shaped to form the inside surface 14 of the shaft, herein tapered and of circular cross-section, and preferably including a spiral groove 32 in the mandrel extending around the selected portion of the mandrel for the rib 20; placing a ribbon 33 of reinforcing material to wrap around the mandrel spirally along the selected portion, in the groove in the preferred mode; applying composite material 34 to the mandrel to form a tubular shaft body 11 around the mandrel; curing the composite material and thereby bonding the reinforcing material 33 to the shaft body 11, and separating the shaft 10 from the mandrel 30. In at least one non-limiting embodiment, the groove may be formed by machining to remove material from the mandrel in a spiral fashion. The groove 32 in the mandrel has the cross-sectional shape selected for the rib, such as from the group shown in FIG. 5, thereby giving this shape to the ribbon of reinforcing material that is placed in the groove.

More specifically, the mandrel 30 is conventional in its configuration, except for the preferred addition of the spiral groove 32 in its outside surface, and the provision of a special coupling 35 projecting axially outwardly from its larger end. The taper of the mandrel is the taper designed for the inside surface 14 of the shaft, the length being somewhat longer than the length of the shafts to be formed on the mandrel.

The step of placing a ribbon of reinforcing material around the mandrel, herein in the groove, may be performed manually, by an operator wrapping a ribbon of material around the mandrel in the groove, or may be performed by machine elements. In the illustrative step shown herein, the ribbon is supplied from a spool 37 (FIG. 8) of the reinforcing ribbon material, having the desired width, thickness and composition, and is machine-wrapped as the mandrel is rotated relative to the spool and the spool is moved longitudinally at the desired rate along the mandrel. As previously mentioned, an acceptable material for the ribbon is a thin strip cut from a pre-impregnated sheet of graphite composite material comprising twenty-eight percent resin and 180 FAW material, which as well known in the industry.

Figures 6, 7, 8, 9, 10:
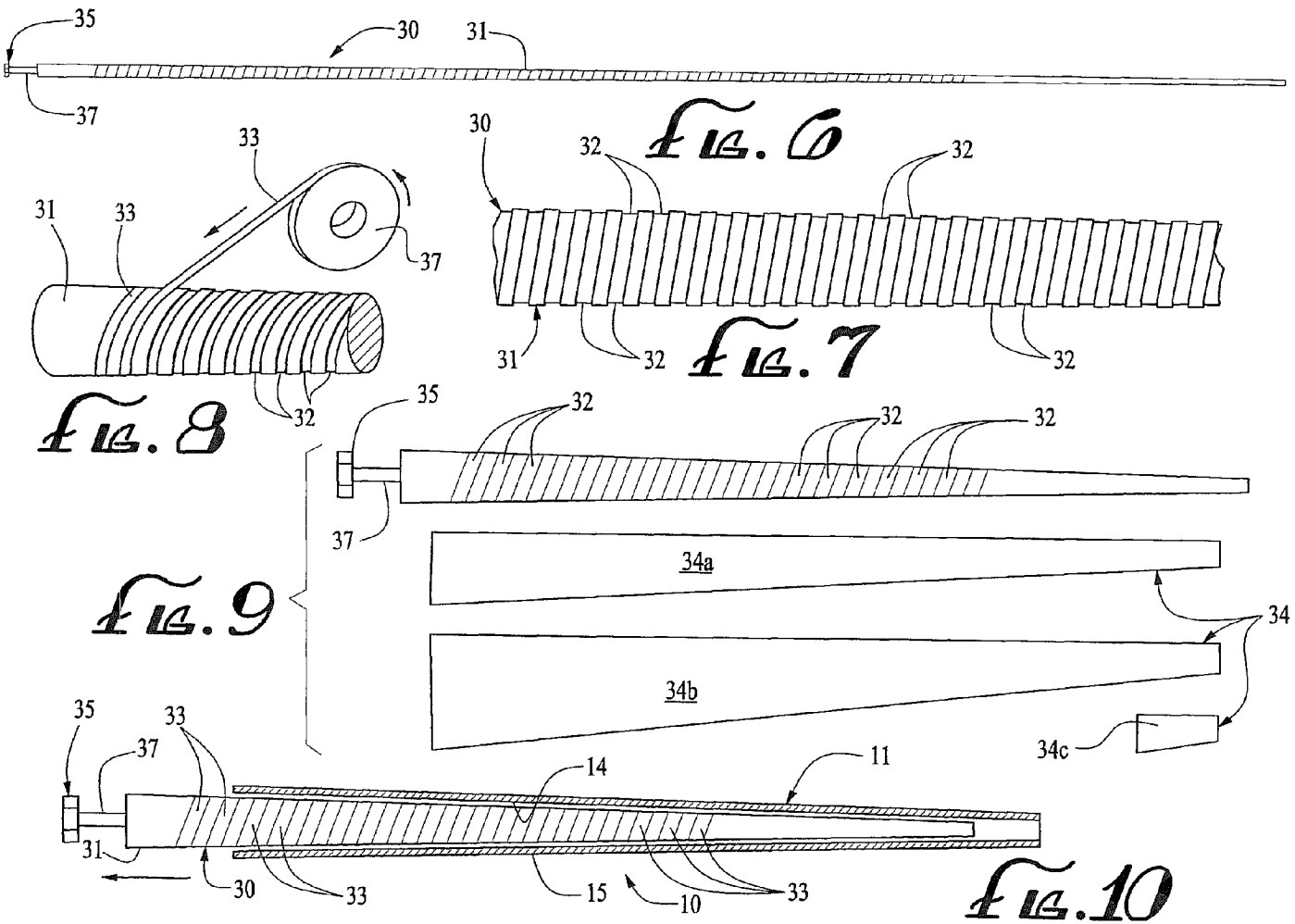
FIG. 6 is a side elevational view of a mandrel in accordance with the present invention, details of the groove not being shown.
FIG. 7 is an enlarged fragmentary schematic side elevational view of a portion of the mandrel that is formed with a spiral groove in its outside surface.
FIG. 8 is a schematic perspective view of a portion of the mandrel shown in FIG. 7, being wrapped with a ribbon of reinforcing material in the spiral groove.
FIG. 9 is a schematic view illustrating the step of wrapping composite sheet material around the mandrel.
FIG. 10 is a schematic view similar to FIG. 9 illustrating the separation of the mandrel from the completed shaft by rotating the mandrel and withdrawing it longitudinally from the shaft.

FIG. 9 schematically illustrates the conventional, and well known, step of applying composite materials, herein represented by a plurality of sheets 34*a*, 34*b*, and 34*c* that are sized and shaped to provide the desired make-up of the body 11 of the shaft when wrapped around the mandrel. While only three pieces are shown, it is to be understood that this is representational only.

The last step in the method of the invention, separation of the shaft 10 from the mandrel 30, is accomplished by, in effect, "unscrewing" the mandrel from the inside of the shaft. This is necessary because of the meshing of the ribbon 33 in the groove 32 in the mandrel 30. The special coupling 35 on the larger end of the mandrel 30 may take various forms, such as a hexagonal head on a coaxial stem 37 joined to the shaft, for engagement by a tool (not shown) for turning the mandrel as it is withdrawn endwise from the shaft 10.

In all other respects, including the finishing of the shaft 10 for use in a golf club, the process may be completely conventional, and various other conventional steps and procedures may be used in performing the steps of the method of the invention.

From the foregoing, it will be evident that the present invention provides, in a relatively simple and effective manner, a golf club shaft having improved hoop strength for improved performance of the golf club made from the shaft. It also will be evident that, while one specific mode of the shaft and the method of the invention have been illustrated and described, various modifications and changes may be made by those skilled in the art without departing from the invention.

I claim as my invention:

1. A method of producing a hollow golf club shaft, comprising:

providing an elongated metal mandrel having an outside surface shaped to form the inside surface of the shaft, the mandrel including a groove formed in an outside surface of the metal and extending spirally around a selected portion of the mandrel;

placing in said groove a ribbon of reinforcing material that wraps around the mandrel along said selected portion;

applying composite material to the mandrel to form a tubular body for the shaft around the mandrel;

curing the composite material on the mandrel, thereby bonding the reinforcing material in the groove to the composite material around the mandrel;

and separating the shaft from the mandrel with the reinforcing material forming a rib on the inside surface of the shaft and spiraling along a selected portion of the inside surface.

2. The method defined in claim 1 wherein the step of placing the ribbon of reinforcing material in said groove is performed by wrapping spirally around the mandrel in the groove a ribbon composed of the reinforcing material and resin and sized to fill the groove.

3. The method defined in claim 1 wherein the step of applying composite material to the mandrel to form a tubular body is performed by wrapping composite sheet material around the mandrel and the ribbon of material in said groove.

4. The method defined in claim 1 wherein the step of separating the shaft from the mandrel is performed by relatively rotating the shaft and the mandrel and withdrawing the mandrel longitudinally from the shaft.

5. The method defined in claim 1 wherein the providing step includes the step of positioning the groove on a selected portion of the mandrel that is spaced from the ends thereof to form the reinforcing rib in a selected intermediate portion of the shaft.

6. A method of producing a hollow composite golf club shaft, comprising:

providing an elongated, longitudinally tapered metal mandrel having an outside surface shaped to form the inside surface of the shaft;

wrapping around the mandrel a ribbon of reinforcing composite material in a spiral extending along a selected portion of the mandrel, wherein the mandrel is in direct contact with the reinforcing material;

applying composite material to the mandrel to form a tubular body for the shaft around the mandrel;

curing the composite material thereby bonding the reinforcing material to the body;

and separating the shaft from the mandrel with the ribbon of reinforcing material joined to the body of the shaft.

7. The method defined in claim 6 wherein said ribbon is composed of fiber-and-resin material.

8. The method defined in claim 1, wherein the groove is formed in the mandrel by a machining process.

9. The method defined in claim 1, wherein the mandrel further comprises a coupling projecting axially outwardly from the larger end of the mandrel.

10. The method defined in claim 6, wherein the mandrel further comprises a coupling projecting axially outwardly from the larger end of the mandrel.

* * * * *